United States Patent [19]

Auer, Jr. et al.

[11] 4,166,599

[45] Sep. 4, 1979

[54] WAYSIDE ORIENTED MOVING BLOCK

[75] Inventors: John H. Auer, Jr., Fairport; Frank A. Svet, Jr., Churchville, both of N.Y.

[73] Assignee: General Signal Corporation, Stamford, Conn.

[21] Appl. No.: 808,745

[22] Filed: Jun. 21, 1977

[51] Int. Cl.[2] ..... B61L 3/20; B61L 27/00

[52] U.S. Cl. ..... 246/63 A; 246/187 B; 246/134

[58] Field of Search ..... 246/3-5, 246/47, 51, 59, 63 R, 63 A, 63 C, 167 R, 187 R, 187 B, 187 C, 134

[56] References Cited

U.S. PATENT DOCUMENTS

| | | | |
|---|---|---|---|
| 3,676,669 | 7/1972 | Jauquet | 246/63 C X |
| 3,740,548 | 6/1973 | Hoyler | 246/3 |
| 3,748,466 | 7/1973 | Sibley et al. | 246/187 B X |
| 3,774,025 | 11/1973 | Auer, Jr. et al. | 246/63 A |
| 3,805,056 | 4/1974 | Birkin | 246/63 A X |
| 3,867,573 | 2/1975 | Birkin | 246/167 R X |
| 3,888,437 | 6/1975 | Birkin | 246/63 A |
| 3,979,092 | 9/1976 | Perry et al. | 246/187 C X |
| 4,023,754 | 5/1977 | Wallgard et al. | 246/167 R X |

OTHER PUBLICATIONS

Pitts; G. L., et al, "Augmented Block Guidance for Short-Headway Transportation Systems", ASME Publication, 9-23-73, pp. 1-8.

*Primary Examiner*—Stephen G. Kunin

*Attorney, Agent, or Firm*—Pollock, Vande Sande & Priddy

[57] ABSTRACT

A control system including apparatus for the transmission of information for the control of vehicles travelling in one direction on a guideway. The guideway is broken down into a plurality of groups of uniquely identified sequential blocks. Each block has at least one vehicle detector for detecting the presence of a vehicle and having an operated condition responsive to vehicle detection. Each block further includes a transmitter for providing, to a vehicle within the block, information concerning the block it is in as well as information regarding the identity of the next downstream occupied or unavailable block. To this end, each block has associated with it a word generator for producing a signal identifying the block; the word generator is coupled to the block transmitter, which transmitter is only enabled when the vehicle detector is in its operated condition. A communication channel extends in a direction opposite to the direction of travel on the guideway, and each block includes a coupler for coupling the portion of the communication channel co-extensive with the block to the adjacent upstream block. The coupler is responsive to the condition of the vehicle detector for maintaining a connection between the communication channel in the block with the communication channel of the next upstream block, when the vehicle detector is not operated. When the vehicle detector is operated, the coupler connects the output of the word generator to the next upstream block. The transmitter of each block receives another input from the communication channel. In this fashion, a vehicle in any block receives a signal identifying the next downstream occupied block as well as a signal identifying the block it is in.

31 Claims, 11 Drawing Figures

TO OTHER VEHICLES & NETWORK ELEMENTS
DP
MOVING BLOCK
FIG IB PRIOR ART
FIXED BLOCK
FIG IA PRIOR ART
FIG IC

GUIDEWAY
N+1
N
N-1
TRN+1
TRN
TRN-1
TO TRANSMITTER N+1
TRANSMITTER
RECEIVER
10
14
CN+1
CN
CN-1
TO WORD SELECTOR N+1
WORD SELECTOR
WORD GENERATOR
12
11
13
MASTER TIMING

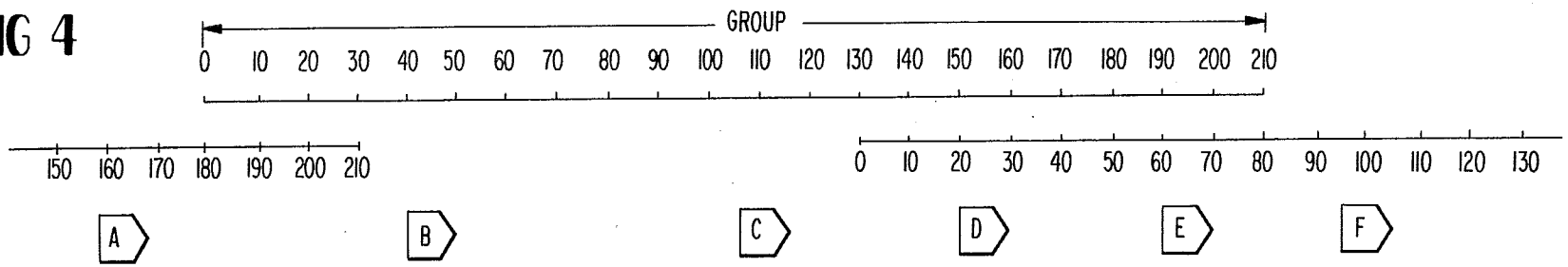
FIG 4
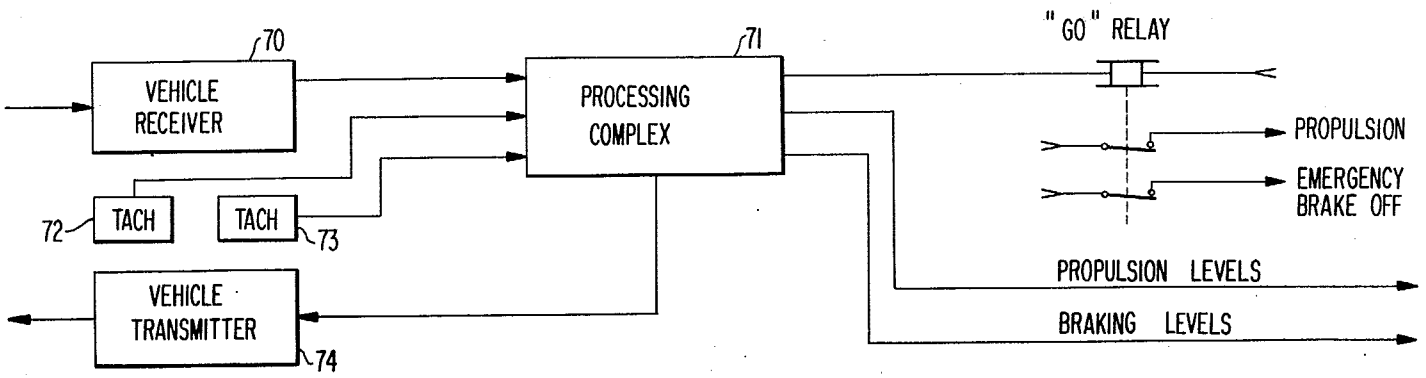
FIG 5
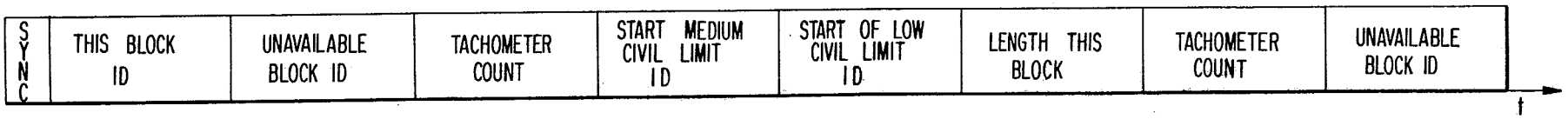
FIG 6 TYPICAL VITAL MESSAGE

WAYSIDE ORIENTED MOVING BLOCK

FIELD OF THE INVENTION

The present invention relates to the control of vehicles moving on a fixed guideway and more particularly to the transmission of information for that control.

BACKGROUND OF THE INVENTION

The present invention relates to the control of vehicles moving on a fixed guideway. For many years, the only application for this technology was to control long distance railroad traffic. More recently, however, the technology has been applied to the control of rapid transit vehicles which, by their nature, were restricted to dense urban areas. Even more recently, however, this technology has also been applied to the control of what is termed "personal rapid transit" or PRT, which technology can be applied to less dense areas than that required by the rapid transit systems.

In this field, two exclusive control philosophies have developed. The earlier control philosophy will, for purposes of this application, be termed "fixed block". In this philosophy, the vehicle guideway is divided into segments called blocks. Apparatus is arranged in each block, for detecting the presence of a vehicle in that block. This wayside apparatus may be coupled to wayside apparatus of one or more adjacent upstream blocks for the purposes of informing vehicles in such upstream blocks of the presence of a vehicle in a downstream block. In one specific application, for example, the block directly upstream of an occupied block is provided with a signal requiring an emergency stop. The next adjacent upstream block is provided with a signal requiring a stop, the next adjacent upstream block is provided with a signal calling for a low speed, and so on. In effect, an information communication arrangement is combined with distributed wayside data processing or computing. In such a system, the vehicle headway, that is, the distance between moving vehicles, is at least one block long, and may, in normal practice, be two or more blocks long. Since the apparatus required for this control philosophy is directly proportional to the number of blocks, economy dictates increasing block length. On the other hand, in order to increase system efficiency, that is, traffic moved per unit of time, decreasing block length is indicated. In the past, a compromise is arrived at fixing a particular block length. However, because of the control philosophy, minimum separation between vehicles is related to block length which is fixed and unchangeable.

In response to the known problems with this control philosophy, the prior art has also developed the "moving block". With this arrangement, each vehicle that is being controlled, transmits its location to a controlling authority, usually on a periodic basis. Thus, the controlling authority has available to it information as to the location and, perhaps speed, of all the vehicles being controlled. Under these circumstances, the controlling authority then provides signals to the vehicles, based upon downstream traffic conditions, allowing the vehicles to proceed at safe speeds, or on the other hand, requiring the vehicles to stop. In effect, a multiple communication arrangement coupled with centralized wayside data processing or computing. At first blush, this approach might appear to solve all the problems of the "fixed block" in that headway can apparently be reduced at will by merely increasing the rate at which information flows from the vehicles to the controlling authority and from the controlling authority to the vehicles. The difficulty encountered herein relates to the vast requirement for information transfer and, if the system is to be automatic, for computing power.

Another difficulty with both prior art solutions is lack of flexiblity to respond to changed conditions. The fixed block is extremely limited in increasing traffic flow above a fixed amount since there is a minimum headway which can only be decreased by reducing block length and block length can only be reduced at extreme expense—it requires a complete replacement of apparatus. The moving block is not as limited since decreases in headway can be achieved by multiplying computing power and information transmission rates. However, these capabilities can only be increased at enormous costs, especially since the computing and information transfer control safety which requires fail safe procedures.

It is therefore one object of the present invention to provide a control philosophy which blends the advantages of both the moving block and the fixed block approach while, at the same time, avoids the disadvantages of each. It is another object of the present invention to provide a control system in which economic advantages of the fixed block approach may be retained, while, at the same time, approaching the flexibility of the moving block control system. Another object of the invention is to simplify the apparatus associated with each block so block length can be reduced without an extreme economic penalty.

SUMMARY OF THE INVENTION

The present invention meets these and other objects of the invention by providing a control system in which each vehicle has provided to it information regarding the next adjacent downstream occupied or unavailable block; the system relies on distributed (vehicle carried) data processing or computing. By using the apparatus and method of the present invention, only a single communication channel is necessary, rather than the multiple communication channels required by the moving block approach. At the same time, however, the single communication channel may provide to any vehicle, the identity of the block it occupies, the identity of the next adjacent downstream occupied or unavailable block, and the speed of a vehicle in such block. With this information, the upstream vehicle's headway can be reduced to approach the headway achievable in moving block systems. Finally, the system can be implemented in stages, as traffic increases, thus exhibiting desirable flexibility.

In accordance with the invention, each block includes apparatus to detect the presence of a vehicle in that block. In addition, each block has a transmitter for providing to a vehicle within that block the identity of the occupied block as well as the identity of the next downstream occupied or unavailable block. Also associated with each block is an identifying means for producing a signal identifying that block and a communication channel which extends between adjacent upstream and downstream blocks. The communication channel provides one input to the transmitter and the identifying means provides another input. Finally, each block includes a coupling means which is operated in dependence upon the condition of the vehicle detecting means. If the vehicle detecting means does not indicate the presence of a vehicle in the block, the coupling means couples the block communication channel to the communication channel of the next adjacent upstream block. If, however, the vehicle detecting means indicates the presence of a vehicle, then the coupling means couples the output of the identifying means associated with that block to the communication channel of the next adjacent upstream block. In this fashion, the transmitter associated with each block has provided to it a signal identifying the next adjacent downstream occupied block and a signal identifying the block. The communication channel can be arranged, if desired, to carry fixed information, such as civil speed limits. Furthermore, if desired, each vehicle can be provided with apparatus for transmitting to the wayside its position or position and speed within a block. This information can be transmitted to the following upstream vehicle along the same communication channel. The upstream vehicle receiving this information can be provided with apparatus to determine its own position within a block. With this information, the upstream vehicle is provided with all the information which the controlling authority has in the moving block system, so that the upstream vehicle can reduce its headway to the minimum required for safety. An occupied block causes that block identity to be transmitted to vehicles in upstream blocks. However, a block including a switch may be unoccupied but nevertheless unavailable if the switch is not lined and locked for a route including the block. Thus, such switch can also result in block identity being transmitted to upstream vehicles. At the same time, however, the control system of the present invention can be implemented in stages so as to gradually reduce minimum headway.

BRIEF DESCRIPTION OF THE DRAWINGS

In describing the present invention, reference will be made to the attached drawings in which identical reference characters refer to identical apparatus, and in which:

FIG. 1A is a schematic representation of a prior art fixed block system;

FIG. 1B is a schematic representation of a prior art moving block system;

FIG. 1C is a schematic representation of the system of the present invention;

FIG. 4 is a schematic of a plurality of blocks illustrating group overlap;

FIG. 5 is a block diagram of vehicle carried apparatus;

FIG. 6 is a timing diagram of a message as transmitted by the wayside apparatus of FIG. 3;

DETAILED DESCRIPTION OF A PREFERRED EMBODIMENT

FIG. 1A is a schematic representation of the prior art fixed block control systems in which block boundaries are identified by short vertical strokes through the horizontal line identifying the guideway. The arrows indicate information transfer capability and the shorthand "DP" refers to data processing. FIG. 1B is a similar schematic illustration of the moving block system. As shown, there are no fixed blocks and the double headed arrows indicate duplex communication. FIG. 1C is a similar schematic illustration of the inventive system. As there illustrated, the data processing function is implemented by vehicle carried apparatus. The wayside function is almost completely information transfer.

Figure 2:
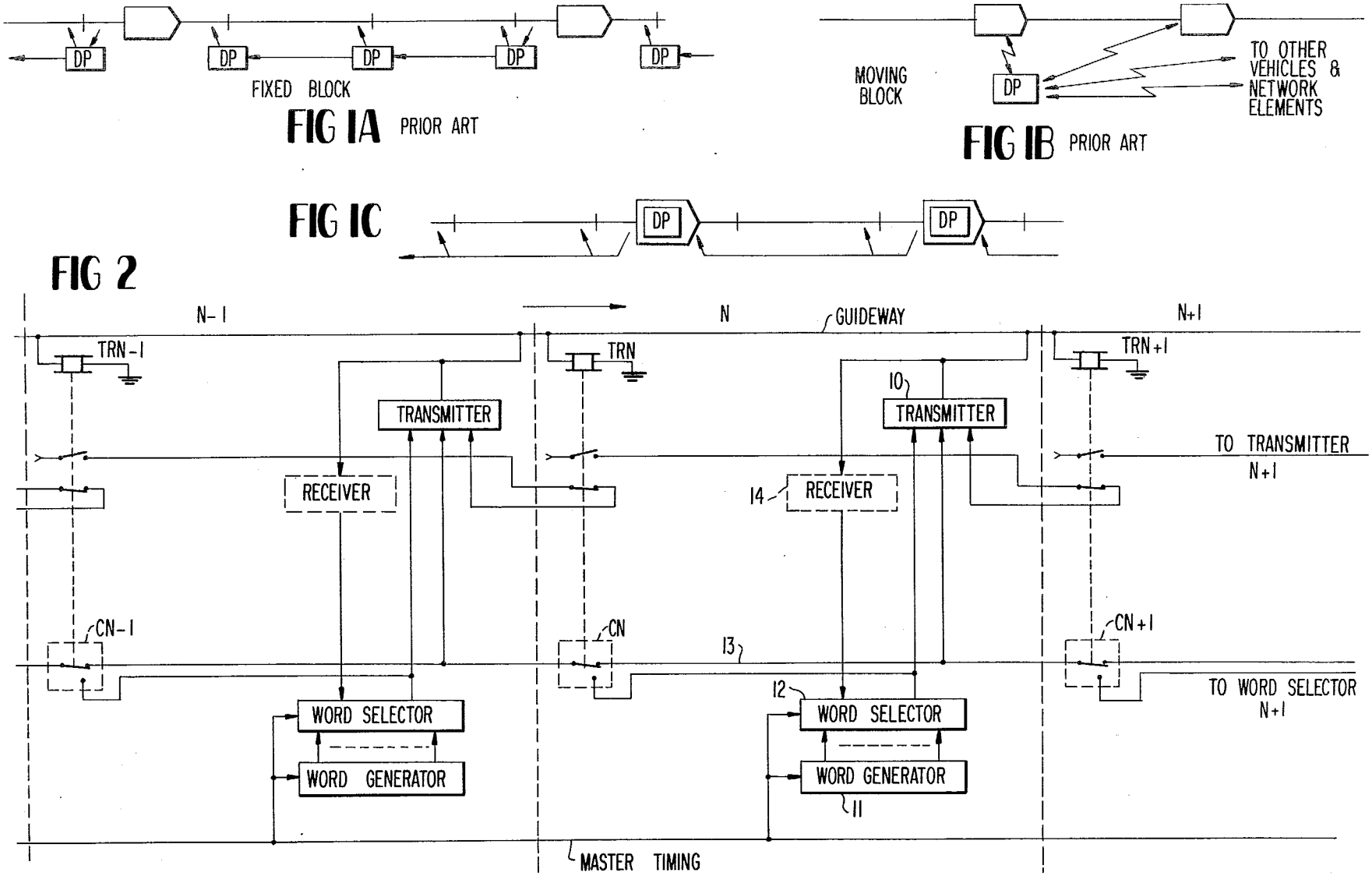
FIG. 2 is a simplified version of apparatus illustrating principles of the present invention.

FIG. 2 is a block diagram of a traffic control system illustrating some principles of the present invention. More particularly, a guideway over which vehicles travel in the direction of the arrow, is broken down into several different segments, termed blocks; blocks $n-1$, n and $n+1$ being shown. The most important characteristic of a block is that any vehicle's position is determinable, by the vehicle detection apparatus, to within a block. As shown in FIG. 2, the vehicle detection apparatus includes a track relay, such as the relays TRN, TRN+1, etc. Those skilled in the art will understand, however, that other vehicle detection means may be employed within the principles of the present invention. The control system of the present invention is based upon distributed decision-making capacity for the purpose of controlling the vehicle's speed. That decision-making capacity is resident on the vehicle and thus, the function of the wayside apparatus is to provide information to the vehicle's decision-making apparatus so that it can determine safe speed, etc. Inasmuch as vehicles travel in the direction indicated by the arrow, the direction of information flow is opposite to that of the travel of the vehicles, that is, vehicles need information regarding the conditions of the guideway ahead, or downstream of the vehicle. Associated with each block is a transmitter 10, which provides information to the vehicle. Although transmitter 10 is shown coupled to the guideway, as is a common expedient in the art, other apparatus for transmitting information to the vehicle can be employed, such as inductive loops, radiowave propagation, waveguides, or the like. Also associated with each block is a word generator 11 and a word selector 12. Both word generator 11 and word selector 12 receive timing information from a master timing channel coupled to all the wayside apparatus, establishing a synchronous communication system. A communication channel 13 is coupled serially from block to block through a coupling unit C in each block. The coupling unit C has one input from the communication channel 13, which is coupled to the downstream coupling unit, and another input from the word selector 12. The output of the coupling unit is connected to the communication channel of the upstream block. The coupling unit is responsive to the condition of the vehicle detecting apparatus for the block. For example, if the vehicle detection apparatus is a track relay, the coupling unit can merely comprise contacts of that relay, arranged so that when the relay is energized (when there is no traffic in the block) the coupling unit couples the output of the downstream coupling unit to the communication channel of the upstream block. On the other hand, if the traffic detecting apparatus detects traffic in the block (that is, the relay is dropped away) then the coupling unit couples the output of the word selector 12 to the communication channel of the upstream block. As a result, information originates at a word selector of an occupied block inasmuch as the coupling unit associated with an occupied block couples the output of the associated word selector 12 to the communication channel 13 which is coupled to upstream blocks. In the first upstream block which is occupied, the vehicle occupying that block receives information from the next adjacent downstream occupied block and information on the block it is in. The information coupled in this fashion is derived in part from word generator 11 of both blocks. Word generator 11 is arranged to provide a signal identifying the block with which it is associated. The master timing 15 gates the word generator 11 and selector 12 at least once per frame to generate "this block" information and at least once per frame to generate "unavailable block" information.

A block may be unavailable even though unoccupied, if, for instance, it includes an open merge switch. Thus, those skilled in the art will realize that for blocks containing switches the coupler C may additionally be responsive to apparatus identifying switch condition.

Also, optionally associated with each block is a receiver 14 which, as is illustrated in FIG. 2, may be coupled to the guideway itself for receiving information transmitted by a vehicle. This information is provided to the word selector 12 associated with the occupied block and thus enables information from a vehicle to be communicated to an upstream vehicle in the same fashion that the signal identifying the occupied block is coupled to an upstream vehicle.

In order to maintain at least one clear block behind each occupied block (if such is desired) no transmission is permitted to a vehicle in any block immediately upstream of an occupied block. To accomplish this, the transmitter power for any block is coupled, through the contacts of the vehicle detection apparatus for the downstream block. In this fashion, if the downstream block is occupied, the transmitter in the upstream block is prevented from transmitting information to a vehicle in such upstream block. Any vehicle which fails to receive a communication will be immediately halted, preferably by an irrevocable emergency stop. Furthermore, since unoccupied blocks do not require information transmission, the transmitter power circuit also includes contacts of the vehicle detector for the block so that, only if a block is occupied, will the transmitter be energized. Actually, in a preferred embodiment of the invention, to be discussed with reference to FIG. 3, two adjacent blocks can be occupied. However, each block has two track circuits (instead of the one shown in FIG. 2) and apparatus is arranged to prevent two adjacent track circuits from being occupied whether in the same block or adjacent blocks.

Figure 3:
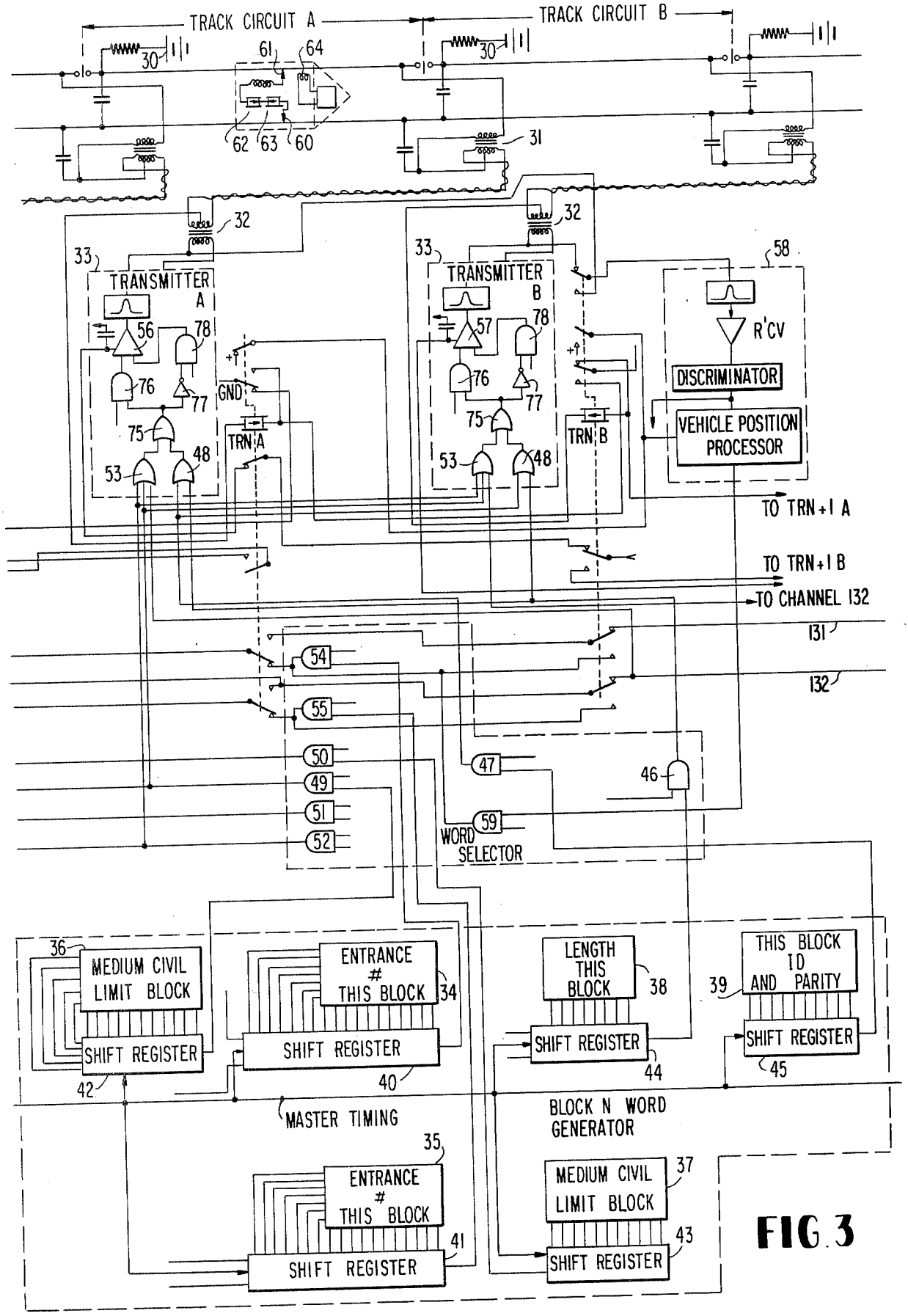
FIG. 3 is a detailed block diagram illustrating wayside apparatus of one block in accordance with the present invention.

FIG. 3 is a detailed block diagram of the apparatus associated with a single block, in accordance with the principles of the present invention. The vehicle detection apparatus employed in FIG. 3 uses a DC track circuit, and in accordance with the preceding discussion, two track circuits are provided for each block, respectively identified as track circuit A and track circuit B. Each track circuit includes a suitable source of potential, such as battery 30, coupled to the entering end of the track circuit. The sources for adjacent track circuits are reversed in polarity. At the exit end of each track circuit there is coupled one winding of a transformer 31. The center tap of the secondary winding of transformer 31 is coupled to the primary, and the secondary of transformer 31 is also coupled to one winding of a transformer 32, whose center tap is connected to a track relay which serves to detect the presence of a vehicle, when the relay drops away. The two track relays for each block are identified by reference characters TRNA for the track relay associated with the upstream track circuit, and TRNB for the track relay associated with the downstream track circuit. The other winding of both transformers 32 are coupled over either front or back contacts of the relay TRNB to a receiver. The foregoing apparatus performs the three functions of vehicle detection, transmission of information to a vehicle, and reception of information therefrom. The manner in which information is gathered to be transmitted to the vehicle, and the handling of information received from the vehicle will now be explained.

Data transmitted to a vehicle includes both fixed and variable information. The fixed information is generated by the apparatus associated with the block and is included within the dotted rectangular labelled block N word generator (corresponding to the word generator 11 referred to in FIG. 2). More particularly, the word generator comprises a plurality of memory devices, such as read-only memories (or the like) 34–39. Associated with each memory device is a parallel/in/serial/out shift register such as shift registers 40–45. In addition to the input to each shift register from the associated memory device, timing signals for loading, clocking and shift enable are provided to each shift register from the master timing line to establish synchronous operation in each block. The output of shift register 44 (identifying the length of this block) and 45 (identifying the identification number for this block) are provided respectively to AND gates 46 and 47. The other input to each of these AND gates is the associated enabling input, provided by the master timing line. The output of AND gates 46 and 47 are provided as inputs to transmitters 33; more particularly, as inputs to OR gates 48 of the transmitters 33.

In addition to providing each vehicle with fixed information regarding the identity and length of the block, wayside apparatus can also be provided to communicate civil speed limit information to vehicles. This identifies downstream blocks in which medium and low speed limits, for instance, are enforced regardless of traffic conditions. Although this information may change, and is therefore not necessarily permanent, it does not change as a function of traffic. It is therefore regarded as fixed information in contrast to traffic related information which is variable. To this end, the output of memories 36 and 37 are provided through shift registers 42 and 43, respectively, to AND gates 49 and 50. Each of these shift registers contain identification of the next downstream block having a medium civil speed limit. Similar memories and registers (not shown) provide inputs to AND gates 51 and 52, which relate to the next adjacent downstream block having a low civil speed limit. The AND gates 49–52 are provided, on their other inputs, with appropriately timed enabling signals from the timing channel. It should be apparent from the foregoing that two sets of memories, shift registers and gates are provided for apparently the same information. The outputs of AND gates 49 and 52 are provided as inputs to OR gates 53 contained in the transmitter 33. The reason for this apparent equipment duplication will become clear, later in this description when the concept of "group overlap" is explained. It is sufficient to note, at this point, that information is thus provided to the transmitters (and thus through them to the vehicles) concerning the identity of this block, this block's length, and the identity of the next adjacent downstream block having a medium civil speed limit and a low civil speed limit.

Information concerning the next adjacent downstream unavailable block is provided on channels 131 and 132, each of which provides information from the next downstream unavailable block. The reason for this apparent duplication of communication channels will also become apparent when the concept of "group overlap" is discussed. Each of these communication channels is coupled through contacts of relay TRNB and TRNA, to the next upstream block. Thus, when the illustrated block is unoccupied, whatever information is received by the illustrated block is passed on to the next upstream block. As shown in FIG. 3, information is provided (from channel 132) as the other input to OR gate 53 (of the upstream transmitter 33) and is picked off channel 132 at a point downstream of the contacts of relay TRNB. The corresponding input to OR gate 53 (of the downstream transmitter 33) is coupled to channel 132 at a point downstream of the contact of the relay TRN+1A. The reason for not picking this signal off channel 132, in the vicinity of block N will be explained later. When the block N+1 is unoccupied, the information provided to both the OR gates 53 of block N is identical.

Information concerning the identity of block N is stored in memories 34 and 35 and provided thereby to shift registers 40 and 41. The output of the shift registers 40 and 41 is coupled respectively to AND gates 54 and 55. The other input to these AND gates is an enabling signal provided by the master timing channel. The output of AND gates 54 and 55 is coupled through the contacts of relay TRNA (when the relay is dropped away) through the communication channels 131 and 132, respectively. Alternatively, the output of AND gates 54 and 55 can be coupled to the communication channels 131 and 132, respectively, when the relay TRNA is picked up if the relay TRNB is dropped away. If both the relays TRNA and TRNB are picked up (indicating the block N is unoccupied) then the output of AND gates 54 and 55 is not provided to the communication channels 131 and 132, but rather the information supplied by the downstream block continues on these channels past block N to block N−1. The preceding illustrates how this block identification can be coupled to the communication channels 131 and 132 when the block is occupied. However, the block may be unavailable for another reason. If the block includes a switch which is not locked it is also considered unavailable for travel into the block is not safe. Furthermore, if the block has a merge switch which is not lined for the route of an upstream leg, travel into the block from that leg is also not safe and the block is considered unavailable. At switch blocks, therefore, the word generator will be coupled to upstream communication channel sections under any of the above-mentioned conditions to thus inform upstream vehicles of block unavailability.

The upstream transmitter 33 can be energized via a supply circuit including +, through the normally closed contact of relay TRNB, through the normally open contacts of relay TRNA to the amplifier 56. A similar supply circuit for amplifier 57, of the downstream transmitter 33, exists over a circuit from the source + through the normally open contacts of relay TRNB, through the normally closed contacts of relay TRN+1A (not illustrated) to the amplifier 57.

The vehicle detecting relay TRNA has an energization circuit from the primary of transformer 32 through the relay and thence through normally open contacts of relay TRNB to ground. This relay has a stick circuit, over the same path through the relay and thence through its own normally closed contact to ground. Similarly, the relay TRNB has an energization circuit from the primary center tap of downstream transformer 32, through the relay, and thence through the normally open contacts of the relay TRN+1A, to ground. This relay has a stick circuit which follows the same path through the relay, and thence through its own normally closed contact to ground. Accordingly, once the relay TRNA is dropped away, it cannot be energized unless the relay TRNB drops away. Likewise, the relay TRNB cannot be energized, after it has dropped away, unless the relay TRN+1A becomes dropped away. This, in effect, "check-in and check-out" feature insures that a vehicle cannot be "lost" because before the track circuit can be cleared, the next track circuit must indicate the vehicle's presence.

Since the power circuit for both transmitters 33 (supplied to amplifiers 56 and 57, respectively) are completed through the normally open contacts of the associated vehicle detector, and the normally closed contacts of the next downstream vehicle detector, as soon as a vehicle crosses the track circuit boundaries to the next downstream track circuit, the energization circuit for the transmitter is opened. Of course, the next downstream transmitter is, at the same time, energized. However, in order to minimize potential "glitches" in the transmitted data, the energization circuit for each of the amplifiers includes a capacitor. As a result, although the energization circuit is abruptly opened, the amplifier continues to be energized at a steadily decreasing power level as the capacitor discharges. Furthermore, for the apparatus illustrated in FIG. 3 in which the vehicle relies upon inductive pickup from the guideway, the transmitter circuit connection to the guideway includes a substantial "antenna" which parallels the guideway so that, even as the inductive pickup crosses the block or track circuit boundary, the transmitter of the track circuit from which the vehicle is exiting, continues to maintain effectiveness until the vehicle is well into the block or track circuit it is entering, and is able to receive transmissions from the transmitter associated with that track circuit.

Before describing the manner in which the illustrated apparatus operates, the concept of "group overlap" will now be explained. The information communicated to a vehicle regarding the next occupied downstream block identifies the block by its identification number. Since a practical length for blocks may be between 100 and 1000 feet, it can readily be appreciated that with any system of significant size, the identification numbers can rapidly become unwieldy if each different block has a unique identification number. To obviate this difficulty, the system of a preferred embodiment has groups of blocks and the block identification number is unique in the group. As a corollary, of course, there are identically identified blocks in different groups. To prevent confusion, that is, to prevent a vehicle from confusing a block in one group with the identically identified block in a different group, the different groups are overlapped.

Referring briefly to FIG. 4, one entire group of blocks, and portions of an upstream and downstream group of blocks are illustrated. The illustrated groups of blocks refer only to the designation of different blocks, and all are resident on a single serial guideway. Each short vertical stroke associated with a number denotes a block boundary, and the associated number identifies the block extending downstream from that block boundary to the next block boundary. It will be noted that the block identification numbers repeat for each group and that the groups overlap each other. The blocks in the overlapping portions of the groups have two different designations. For example, blocks 180, 190, 200 and 210 of the most upstream group, are identical with blocks 0, 10, 20 and 30 of the middle illustrated group, and blocks 130–210 of the intermediate group are identical with blocks 0–80 of the downstream-most group. Each block which has double designation thus requires a word generator for each of its designations, and if such a block is occupied, both designations are transmitted over a different communication channel, such as the communication channels 131 and 132, illustrated in FIG. 3. Which of the information channels is coupled to the transmitter of an upstream block depends upon which group the upstream block is in. For example, the presence of vehicle E in block 60 (or 190) causes both those designations to be transmitted on a different communication channel to upstream blocks. Every transmitter associated with the blocks 0–60 receives the designation 60 as the next downstream occupied block, and therefore vehicle D receives the designation 60 as the next downstream occupied block. The designation 190 is only made available to those vehicles upstream of block 0. As a further example, the presence of vehicle D in block 20–150 causes both those designations to be transmitted to upstream blocks. However, the designation 20 is terminated at block 0, and therefore, the vehicle C receives the designation 150 as the next downstream occupied block. In a practical implementation, this is effected by connecting the proper communication channel to the block transmitter, and omitting the connection between the inappropriate channel and the block transmitter. Refer now to FIG. 3 where it is apparent that channel 132 is connected to the transmitters 33, and channel 131 is not connected to the block transmitters.

In a similar fashion, the stores which contain information corresponding to the next low civil speed limit block and the next medium civil speed limit blocks are only necessary at group boundaries or following blocks which have low or medium civil speed limits imposed. For example, assume that a medium civil speed limit is imposed on block 170–40 (i.e., the block 170 of the intermediate group, which is also block 40 of the downstream group). Apparatus must be provided at block 170–40 to communicate to upstream vehicles the presence of this medium civil speed limit. However, a single gate at this block, transmitting the designation 40 can be used for blocks 0–40. On the other hand, similar apparatus at this block must be employed to transmit the designation 170 to vehicles upstream of block 0. Thus, this communication channel between blocks 170 and 130 is not connected to any transmitter, whereas in blocks upstream of block 0, it is connected to the transmitters.

Returning now to FIG. 3, the only apparatus illustrated there which has not yet been discussed is the receiver 58. As explained above, the receiver 58 is an optional feature which can be added to further reduce headway constraints. There is one receiver per block (that is, per two track circuits) and it is adapted to receive a vehicle transmitted message with regard to the vehicle's position in the block and perhaps its speed as well. The input to the receiver 58 is coupled over a front contact of relay TRNB to the secondary of the upstream transformer 32, and over the back contact of relay TRNB to the secondary of the downstream transformer 32. In this fashion, the vehicle's message is provided to the receiver 58 regardless of which track circuit the vehicle occupies. As illustrated in FIG. 3, the receiver 58 includes a tuned circuit, amplifier and discriminator and a vehicle position processor. The position processor may perform no function other than checking the vehicle message for validity, i.e., proper parity, etc. Such circuits are well-known to those skilled in the art and depend, of course, on the particular communication code selected. The output of the position processor, which is the output of the receiver, is provided to AND gate 59. The other input to AND gate 59 is a gating signal derived from the master timing channel. The output of AND gate 59 is provided to communication channel 131. This connection is made either over a back contact of relay TRNA or a back contact of relay TRNB. In this fashion, the vehicle's position can be transmitted to upstream vehicles regardless of which track circuit the vehicle occupies since one of these back contacts is always closed.

One may question why the transmitters 33 of block N are connected to channel 132 while the block N receiver 58 is coupled to channel 131. The answer is a further illustration of the "group overlap" principle. More particularly, block N is at a group boundary, such as block 180–0 (FIG. 4). Channel 132 is coextensive with the intermediate group and is thus coupled to the transmitters 33 of block N. However, since the vehicle information is destined for upstream vehicles, i.e., vehicles in blocks upstream of 180, its data is coupled to channel 131, which is the channel coupled to immediately adjacent upstream blocks.

FIG. 5 illustrates the configuration of the vehicle's on-board apparatus to operate with the control system disclosed above. As shown in FIG. 3, the vehicle includes a pair of brushes 60 and 61, which provide a shunting path for the DC energy on the guideway to insure that the associated vehicle detector (TRNA or TRNB) becomes dropped away when the vehicle is in the associated track circuit. Also coupled between brushes 60 and 61 are a pair of relays 62 and 63 which are energized by currents of opposite polarity. It will be noticed that the current sources for the adjacent track circuits are of opposite polarity. Accordingly, when the vehicle is in one track circuit, one of the relays 62 or 63 will be energized, and conversely, when the vehicle is in the next track circuit the other of relay 62 and 63 will be energized. Energization of either of the relays 62 or 63 provides evidence that the vehicle has manifested its position to the wayside by shunting current away from the track circuit. The energization of one of these relays, at all times, is one necessary ingredient to allow the vehicle to proceed. Each vehicle also includes an inductive pickup 64 for the purpose of receiving communications transmitted by the wayside, and for transmitting to the wayside. Although inductive coupling is illustrated, those skilled in the art will realize that other forms of communication can be employed as well.

Turning now to FIG. 5, which illustrates, in block diagram form, the vehicle carried apparatus, we see that it includes a vehicle receiver 70 which may be coupled to the coil 64. The receiver 70 makes the communicated information available to a processing complex 71. Further inputs to the processing complex are provided by a pair of tachometers 72 and 73. Other inputs to the processing complex may be provided by other vehicle carried sensors for sensing other vehicle parameters. The selection of other inputs to the processing complex, and the apparatus to provide those inputs, are known to those skilled in the art. The processing complex can comprise one or more central processing units each of which can comprise a different microprocessor or the like. In some applications, it may be desirable to have two or more microprocessors performing essentially the same function and allowing the output to be effective if, and only if, all or a majority of the microprocessors agree. Other functions need not be performed by multiple microprocessors, and a single processor will be sufficient. In any event, assuming that the information received by the vehicle as well as the information generated on board the vehicle indicates that continued vehicle travel is safe, an output is provided to energize a "GO" relay. The front contacts of this relay provide power to insure that the emergency brake is not applied, and also provides one necessary signal for energizing the propulsion apparatus. Other outputs of the processing complex 71 select propulsion or braking levels. The processing complex 71 may also provide a signal to a vehicle carried transmitter which may also be coupled to the same coil 64 for the purpose of communicating information to the wayside. Since the processing complex 71 is responsive to information communicated from the wayside to the vehicle receiver 70, it can, and should be, synchronized with the synchronous communication cycle established by the wayside transmitters. Thus, the vehicle generated information coupled through the vehicle transmitter 74 can be received by the wayside receiver and gated onto the communication channels 131 or 132, timed to be synchronous with the other information on those channels.

FIG. 6 is an example of a preferred format for a typical vital message. The message includes a number of words, and is preceded by a synchronization pattern which may actually be stored and gated out. For example, the sync pattern may be provided through gate 47 preceding the first word. The first word is the identification of the block the vehicle is in, provided through gate 47. The next word is identification of the next downstream unavailable block, provided through one of gates 54 or 55 depending upon which of the communication channels 131 or 132 is coupled to the block transmitter. The next word is the tachometer count of the adjacent downstream vehicle provided through gate 59 and the associated communication channel. Likewise, the next two words are the identification of the start of the next downstream medium civil limit and the start of the next downstream low civil limit provided by one of gates 49, 50 and 51, 52. The next word is the length of the block the vehicle is in provided through gate 46. The tachometer count of the next downstream vehicle is provided through gate 59 again, and the next downstream unavailable block is also provided again through one of gates 54 and 55. Each of the words in the message may be formatted for error control purposes by techniques well known to those skilled in the art, for example, by adding parity bits. The words illustrated in FIG. 6 may include the message in true and inverted form, as disclosed in the co-pending application of Henry C. Sibley, Ser. No. 751,565, filed Dec. 17, 1976, and assigned to the assignee of this application, now U.S. Pat. No. 4,103,564.

The double inclusion of the tachometer count and the unavailable block identification is provided to reduce message glitches caused by a lead vehicle crossing a block boundary. Since the messages are generated and transmitted in real time, when a lead vehicle crosses a block boundary at a time when the unavailable block identification is being generated the new track relay dropping away and the old track relay picking up may cause the block identification to be garbled; some of its bits may be from the block that has just been vacated while the remaining bits may be provided by the new block. Obviously, such identification would not be meaningful. By transmitting the unavailable block identification twice per frame, this disturbance is minimized. Similarily, the tachometer count may be reset at block boundaries. If it is, the passage of a block boundary while the count is being sent will cause a garbled message, so this information is sent twice per frame.

By like token, when a receiving vehicle crosses a block or track circuit boundary, one transmitter is deenergized and the other transmitter is energized, and the switching could garble the message. In order to minimize this effect, the unavailable block identification and the tachometer count information, that is, the information derived from channels 131 or 132, is not picked off the portion of those channels associated with the block, but is picked off the communication channel at the next downstream block. Since the next downstream block of the trailing vehicle should always be unoccupied, there would be no switching involved as the vehicle in the upstream block proceeds across the block boundary or track circuit boundary. While crossing block and track circuit boundaries may also garble the civil speed limit information, "this block's length" and "identification" information, this garbling, if it occurs, can be tolerated. Civil speed limit information is sent upstream well in advance of the point where a vehicle will need it so that the vehicle is already aware of this information and can merely disregard the garbled information. The vehicle uses "this block identification" and "this block's length" only as verification for on-board calculations. As a result, it is not essential that the vehicle receive and process this information immediately. For example, the vehicle can compute this block's identification knowing the last block's identification. The processing complex 71 can be arranged to allow for several messages to be received and only indicate a failure condition if all the messages are garbled. Due to the vehicle's motion, as well as the antenna overlap, garbling due to crossing track circuit and block boundaries is not that extensive.

As mentioned above, the transmitters across track circuit and block boundaries are switched in and out in a gradual fashion by reason of the capacitor across the power supply for the transmitter amplifier. This is beneficial, and can only be detrimental at group boundaries where having two amplifiers transmitting at the same time, and necessarily transmitting different information could result in signal cancellation if there is 180° phase shift between the two transmitter signals. To remedy this, it is only necessary to shift the transmitter carrier frequency so that the carrier frequencies in one group differs from that in the second group, thus negating the possibility of complete cancellation.

From the preceding discussion, the operation of the inventive apparatus should be apparent. More particularly, assuming a vehicle is in a particular block and track circuit, as shown in FIG. 3, and the master timing channel gates appropriate information from either the communication channels 131 or 132, or the memories associated with the block, through appropriate gates and eventually through either OR gate 53 or 48. The output of these OR gates are provided to OR gate 75 which provides an output to an AND gate 76 and an inverter 77. The AND gate 76 has another input derived from one oscillator of an oscillator pair in a frequency shift transmitter arrangement. The inverter 77 provides an input to an AND gate 78 whose other input is provided by the other oscillator of the frequency shift transmitter pair. The outputs of the AND gates 76 and 78 are provided to the amplifier 56 whose input is coupled through transformers 32 and 31 to the associated track circuit. This apparatus not only transfers the wayside generated information to the associated vehicle, establishes the communication synchronization with the vehicle carried transmitter, and also transfers information from the leading vehicle to the trailing vehicle. In addition to utilizing this information on board the trailing vehicle to compute a go/no go signal, the trailing vehicle can also compute its safe speed and adjust its propulsion and braking equipment accordingly. The trailing vehicle also may couple information generated on board that vehicle to the wayside circuits for transmissions to vehicles upstream of the trailing vehicle.

While the embodiment here disclosed employed both wayside to vehicle transmission as well as vehicle to wayside transmission, and necessarily therefore employed a wayside receiver, that apparatus is not essential to the invention. Rather, the invention can be implemented omitting the vehicle to wayside transmitter along with the wayside receiver. Under those conditions, the trailing vehicle is informed only of the location of the next unavailable downstream block. By employing the tachometers employed on the vehicle as well as identification of the block in which the vehicle is, the trailing vehicle can then compute safe maximum velocities, although not informed of the velocity or precise position of the leading vehicle. Although the trailing vehicle may have to accept a more conservative limiting velocity because it does not know the location of the lead vehicle, this merely limits the system headway. Nevertheless, with a tachometer the trailing vehicle knows how far into the block it is and therefore it need not operate on "worst case" assumptions. It is a particularly advantage of the invention that the vehicle to wayside transmission of the vehicle's velocity and position within a block, for reception by a trailing vehicle, can be added after the system is installed. Adding this apparatus enables headway to be reduced, but the fact that this apparatus need not be installed immediately gives the system added flexibility in that it has the capability of reducing headway when such headway reduction appears necessary in light of traffic conditions.

For further reducing headway requirements, over and above the basic vehicle to wayside transmission disclosed above, added communication capabilities may be provided. Such communication capabilities, for example, include transmission to a vehicle of the position of a merge or diverge switch downstream of the vehicle, as now will be disclosed. The word selector at a merge switch block passes to the upstream leg of the aligned route information derived from downstream of the merge block, as disclosed above. The word selector does not pass this information to the upstream leg of the unaligned route, instead the block is reported as unavailable for the switch is open. During switch movements, the leg to be aligned can receive information regarding time to switch locking as well as downstream data while the route to be opened has the block reported as unavailable. Switch movements can be controlled in accordance with an additional communication channel directed downstream (opposite in direction to the disclosed communication channels).

Figure 7:
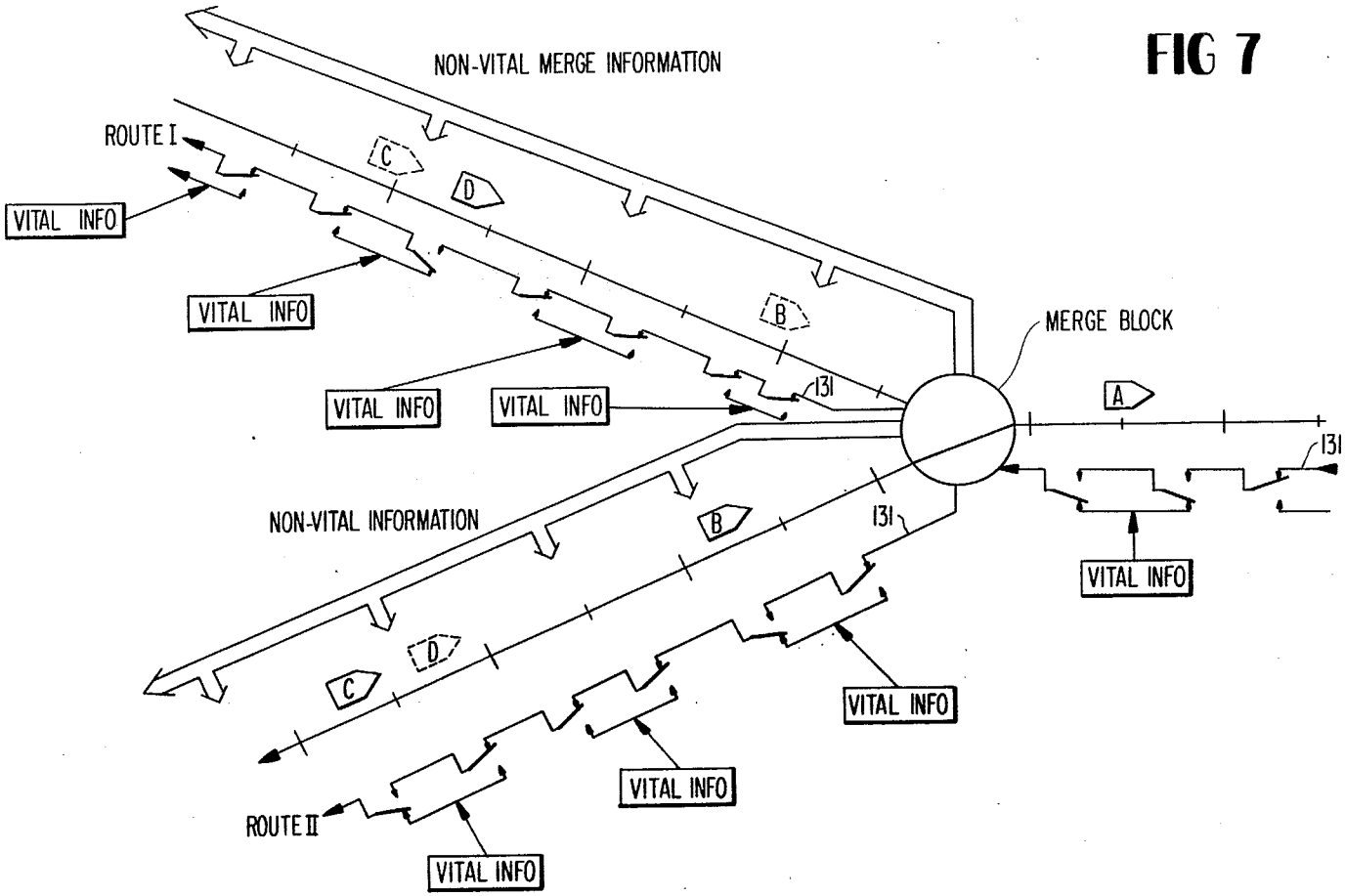
FIG. 7 is a block diagram showing added communication facilities in the vicinity of a MERGE BLOCK.

FIG. 7 shows the apparatus associated with a MERGE BLOCK. The MERGE BLOCK is at the junction of two guideway legs identified in FIG. 7 as ROUTE I and ROUTE II. The communication channels 131 are diagrammatically illustrated, although much of the apparatus shown in FIG. 3 has been omitted for purposes of clarity. The various inputs to the communication channels 131 identified as VITAL INFO corresponds to the message sources for the communication channel 131 shown in more detail in FIG. 3. Furthermore, the receivers and transmitters have also been omitted for purposes of clarity. As illustrated in FIG. 7, two vehicles are travelling on ROUTE II, vehicles B and C, a single vehicle D is travelling toward the MERGE BLOCK on ROUTE I and the vehicle A is downstream of the MERGE BLOCK. As shown in FIG. 7, the MERGE BLOCK is lined for ROUTE II, to allow vehicle B to traverse the MERGE BLOCK and continue downstream. A further communication channel is provided for each of the routes upstream of the MERGE BLOCK, identified as NON-VITAL MERGE INFORMATION. This communication channel can be time multiplexed onto the channels 131 carrying vital information or, in the alternative, can comprise a separate communciation channel and can be coupled to the guideway through a separate transmitter. The vehicles B and C, travelling on ROUTE II are shown in phantom position on ROUTE I, in dotted outline and correspondingly, the vehicle D travelling on ROUTE I is shown as a phanton vehicle in dotted outline, on ROUTE II. One of the purposes of the NON-VITAL MERGE INFORMATION channel is to provide information to vehicles approaching a merge block regarding vehicles on the other leg of the merge block. Of course, to provide this information, the merge block must be knowledgeable about these vehicles and for this reason, a downstream communication channel is provided, although not illustrated in FIG. 7.

Figure 8:
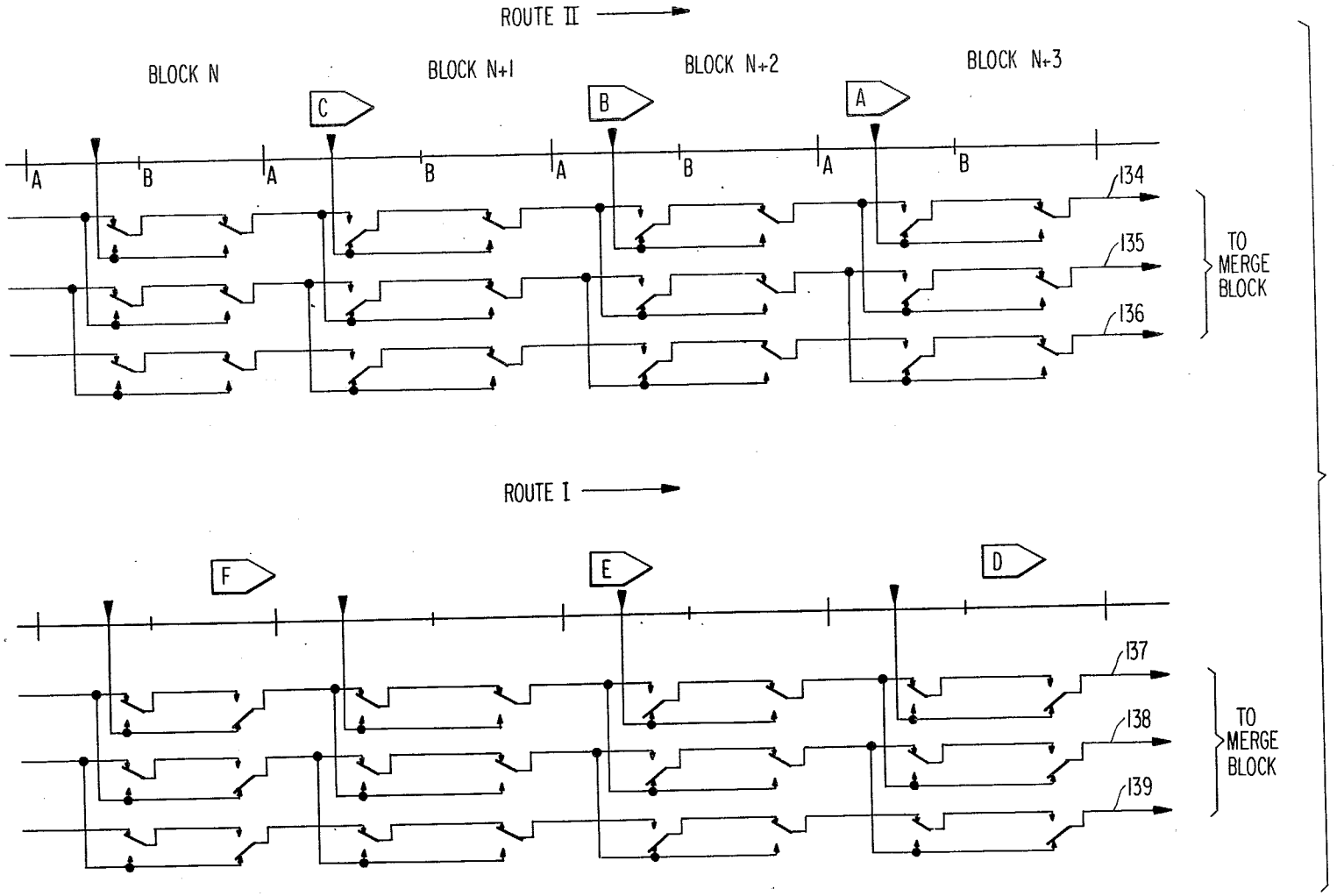
FIG. 8 is a showing of a downstream communication link for use with the apparatus of FIG. 7; and, FIG. 9 is a block diagram of apparatus at the MERGE BLOCK for reception and formatting of data flow.

FIG. 8 illustrates, in schematic form, the downstream communication channel for each of ROUTES I and II. Taking up the showing in FIG. 8 related to II, the guideway is identified by the horizontal line and the short vertical strokes identify track circuit boundaries, the letters A and B identify the two track circuits in each block. Actually, the downstream communication channel comprises multiple communication channels, a different communication channel is provided for each upstream vehicle which is to be identified. Thus, for example, in FIG. 8, three downstream communication channels are provided, thus allowing for identification of three upstream vehicles in a route. For purposes of illustration, those vehicles A, B and C are illustrated. The communication channels are coupled through contacts of the couplers for each track circuit as shown in FIG. 8. More particularly, vehicle carried information is communicated to a communication channel over a wayside mounted receiver, each receiver is coupled to a back contact of the vehicle detector for the block. Thus, vehicle A in block N+3 has vehicle carried information coupled to a back contact of the vehicle detector located in block N+3. Since the vehicle is in the associated block, the data transmitted by the vehicle including block ID, position in block, speed and destination, is coupled to the communication channel 134. Assuming that there are no vehicles downstream of vehicle A in ROUTE II and upstream of the MERGE BLOCK, the MERGE BLOCK would receive this information on the communication channel 134. Refer now to vehicle B, in block N+2 (the following discussion would hold true no matter how many blocks upstream of block N+3 the vehicle B was in). Just as in the case of vehicle A, vehicle B information is coupled to communication channel 134, although it is upstream of the position at which vehicle A's information is coupled to that communication channel. The information travels down the communication channel 134 to a point in block N+3 upstream of the contacts of the vehicle detectors where it is also coupled to a back contact of a vehicle detector coupled into communication channel 135. Since block N+3 is occupied, vehicle B's information will not be coupled downstream on communication channel 134, but it will be coupled into communication channel 135 and be carried downstream thereby. Refer now to vehicle C, present in block N+1. The vehicle C information is also coupled into communication channel 134 at the back contact of the vehicle detector and it travels down the communication channel to a point just upstream of the next occupied block, where it is also coupled to communication channel 135. Since the upstream block is occupied, vehicle C's data is then coupled into communication channel 135 where it again travels downstream to the next occupied block where it is coupled into a communication channel 136 at a back contact of a vehicle detector. Thus, the block ID, position in the block, speed and the destination of each of the vehicles A, B and C are transmitted downstream on communication channels 134, 135 and 136 to the MERGE BLOCK receiver. Vehicles upstream of vehicle C would not be identified on the MERGE BLOCK due to a lack of additional communication channels. However, as soon as vehicle A entered the MERGE BLOCK, vehicle B's information would be presented on communication channel 134, vehicle C's data would be presented on channel 135 and any upstream vehicle's data would be presented on channel 136. Thus, the three communication channels provide a communication path for information from three upstream vehicles closest to the MERGE BLOCK in ROUTE II.

Similar apparatus is provided for ROUTE I, as also shown in FIG. 8, wherein vehicles D, E and F are travelling on that route toward the MERGE BLOCK. Those skilled in the art will be aware, of course, that three communication channels per route are not mandatory, and the number can be varied to suit the needs of the particular system.

Preferably the downstream destined data can be time multiplexed through the same wayside receiver (of FIG. 3) and gated onto the downstream channels. With such arrangement, of course, timing is important and the vehicle's transmission timing is controlled by the wayside to vehicle transmission, as shown in FIG. 3. Furthermore, "this block" data transmitted by the vehicle originates, of course, on the wayside and is transmitted to the vehicle where it is re-transmitted to the downstream channels. If desired, of course, "this block" data may be gated out of the wayside shift register (of occupied blocks) directly for the downstream circuits.

Figure 9:
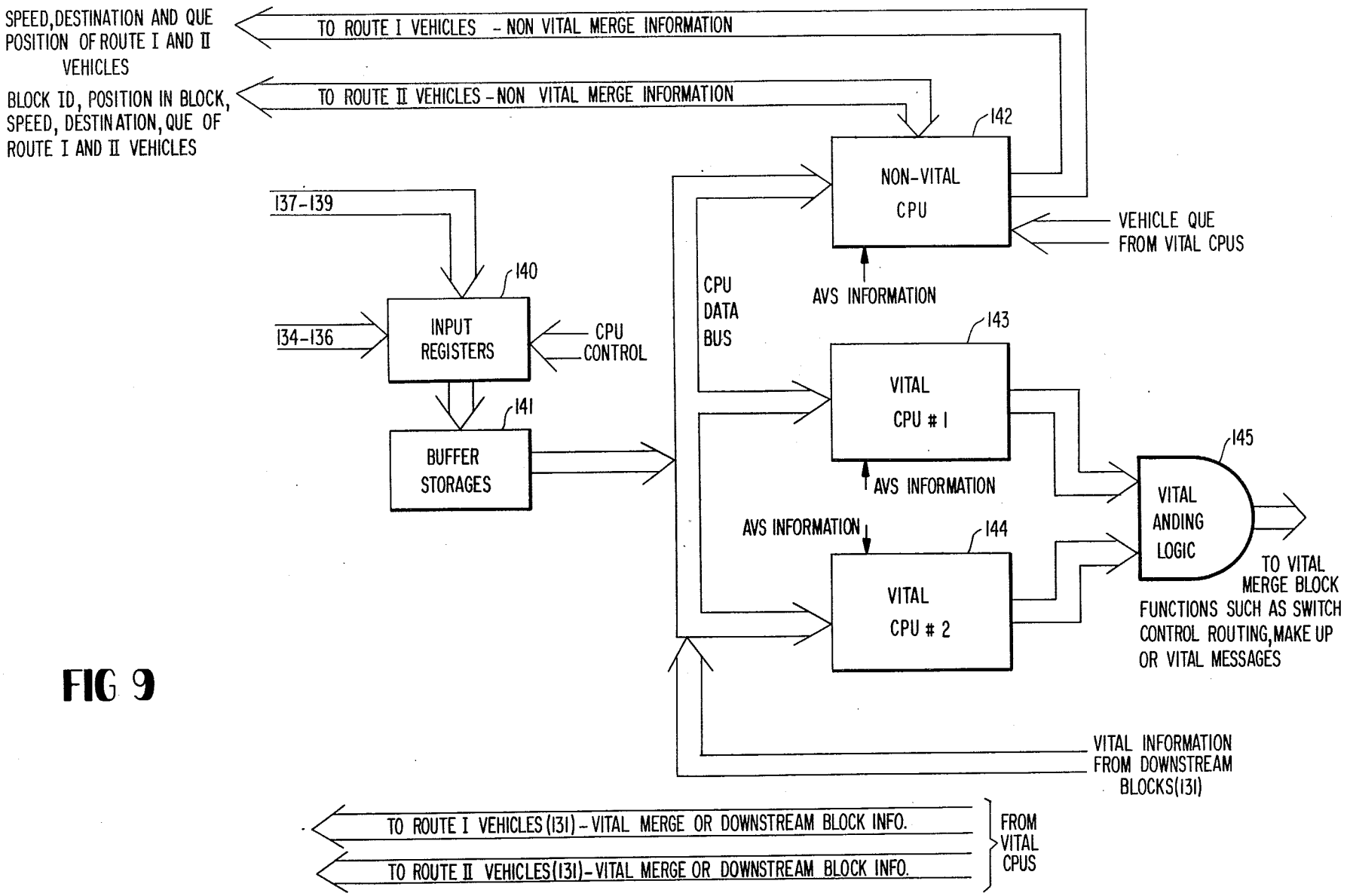

The MERGE BLOCK apparatus to handle the information and make it available in proper form is shown in FIG. 9. FIG. 9 shows that the communication channels associated with ROUTE I (137–139) as well as the communication channels associated with ROUTE II (134–136) are coupled to a plurality of input registers 140. At the proper time the data in input registers 140 is coupled to buffer storages 141 and thence to a CPU DATA BUS. This BUS makes this data available to two vital CPU's 143 and 144, as well as a non-vital CPU 142. The data bus is also provided with information from locations downstream of the MERGE BLOCK, for example, over the communication channel 131. This identifies, as disclosed above, first downstream vehicle, the block it is in, perhaps its position and speed, as well as civil speed limit information. The two vital CPU's 143 and 144, employ the upstream originated information to generate a list of the vehicles approaching the MERGE BLOCK, and the necessary position of the merge switch to allow the vehicle to pass through the MERGE BLOCK. Inasmuch as the operations of the CPU's 143 and 144 are considered vital, the two CPU's perform essentially identical functions and their outputs are compared in vital ANDING logic 145. If the outputs compare, the data is employed to control the merge switch and to make up vital messages for upstream vehicles. The formatted messages are shown diagrammatically in FIG. 9 as being transmitted over the communication channels 131 in ROUTES I and II. The messages formatted and transmitted by the MERGE BLOCK hardware to upstream vehicles on the channels 131 include block ID of MERGE BLOCK, block ID of the next unavailable block downstream, information alerting the vehicle that it is approaching a MERGE BLOCK, as well as block ID of civil speed limits in the area. The MERGE BLOCK switch is controlled in accordance with the list of approaching vehicles such that, for example, the MERGE BLOCK is allowed to let the closest vehicle pass through the MERGE BLOCK. The list may be modified by additional information received from a system control central station based on external parameters.

The vital message, transmitted on communication channel 131, for the unaligned route, will be different than the message for the aligned route. For the unaligned route, this data will consist of the block ID of the MERGE BLOCK which will be identified as unavailable, since the route is unaligned, data informing the vehicle that the unavailable block is a MERGE BLOCK, the block ID of the first unavailable block downstream of the MERGE BLOCK and data identifying civil speed limit information in the area.

A further output of the listing of vehicles approaching the MERGE BLOCK on both ROUTES I and II is provided as an input to the non-vital CPU 142. This apparatus formats and transmits the non-vital merge information to vehicles in both ROUTES I and II, see for example, FIG. 7. The non-vital message information consists of the block and route ID, position in the block, speed, destination and list position of the closest vehicles to the MERGE BLOCK. This data would, for the example shown in FIG. 8, identify the six closest vehicles, three on each ROUTE. With this information, each vehicle can adjust its speed based upon the phantom position of the vehicles with which it will be merging at the MERGE BLOCK to provide for a smooth merging.

While the non-vital merge information will be received by plural vehicles, the vital information, transmitted on communication channel 131 will be received by only two vehicles, the closest vehicles in each of the routes to the MERGE BLOCK. For any vehicle located upstream of a MERGE BLOCK, which has a vehicle between itself and the MERGE BLOCK, the only data it will receive regarding the merging operation will be the non-vital merge information. Of course, as soon as the downstream vehicle between a vehicle and the MERGE BLOCK crosses the MERGE BLOCK, that vehicle will now become the closest vehicle on the route to the MERGE BLOCK and accordingly, will receive both the non-vital merge information as well as the vital merge information.

While a preferred embodiment of the invention has been disclosed herein, which employs a combination of digital techniques for the storage, transmission and reception of certain classes of information, and conventional railroad techniques for vehicle detection and information switching purposes, it should be apparent that the invention can also be implemented using completely digital techniques. For example, by driving the track circuits with pulsed energy instead of direct current, a microprocessor can be substituted for the conventional vehicle detectors disclosed in FIG. 3, which microprocessor can then perform the function of vehicle detection, and also can perform the information switching functions performed by the discrete gates illustrated in FIG. 3.

We claim:

1. Apparatus for the transmission of traffic control information to vehicles travelling in one direction on a guideway wherein said guideway comprises a plurality of sequentially coupled blocks comprising:

a plurality of vehicle detecting means each associated with a different block for detecting the presence of a vehicle in said associated block, transmitting means associated with each block for providing traffic control information to a vehicle in said block, and, information selecting means coupled to said transmitting means and coupled to each said vehicle detecting means, said information selecting means coupling to each said transmitting means information identifying the next adjacent downstream unavailable block regardless of the number of clear blocks between said transmitting means and said unavailable block.

2. The apparatus of claim 1 wherein said information selecting means comprises:

a communication channel section associated with each block having an input and output, a coupling means associated with each block and responsive to a vehicle detecting means associated with said block, for coupling the output of said associated communication channel section to the input of a communication channel section of the adjacent upstream block if said vehicle detecting means does not detect presence of a vehicle, and an information storage means associated with each block storing identification of the associated block and coupled to said coupling means, said coupling means coupling said information storage means to the input of the communication channel section of the adjacent upstream block when said vehicle detecting means detects the presence of a vehicle in said block.

3. The apparatus of claim 2 further comprising further storage means associated with each block and coupled to the associated transmitting means for providing information identifying the associated block.

4. The apparatus of claim 3 which includes means coupling timing signals to said information storage means and said further storage means for controlling the times their respective information is transmitted, said timing signals including at least a first and second gating signals of like repitition rate but time displaced from each other.

5. The apparatus of claim 4 which includes:

receiving means associated with each said block responsive to a vehicle carried transmitter, said receiving means having an output coupled to said associated communication channel section.

6. The apparatus of claim 4 in which:

said vehicle detecting means includes an upstream vehicle detector and a downstream vehicle detector, each respectively detecting presence of a vehicle in an upstream or downstream section of said block, and said transmitting means includes an upstream and downstream transmitter transmitting to a vehicle in an associated section of said block.

7. The apparatus of claim 6 wherein said communication channel section has an upstream and downstream segment, said coupling means has an upstream and downstream coupler, said downstream coupler coupling an output of said downstream segment to an input of said upstream segment and said upstream coupler coupling an output of said upstream segment to an input of a downstream segment of the next adjacent upstream block.

8. The apparatus of claim 7 wherein said upstream transmitter has an input from said communication channel section downstream of said downstream coupler and said downstream transmitter has an input from the communication channel section of the adjacent downstream block, coupled downstream of said upstream coupler.

9. The apparatus of claim 7 in which said transmitting means is responsive to said vehicle detecting means to transmit only when the associated block is occupied.

10. The apparatus of claim 9 in which information selecting means couples information identifying the next downstream occupied block.

11. The apparatus of claim 9 in which said information selecting means couples information identifying a merge block with an unaligned switch.

12. The apparatus of claim 9 in which said information selecting means couples information identifying a switch block with an unlocked switch.

13. The apparatus of claim 6 in which each of said transmitters is enabled by the associated vehicle detector detecting a vehicle and each said transmitter has capacitor means coupled in parallel between a power input terminal and ground.

14. The apparatus of claim 6 wherein each said vehicle detector includes:

a track circuit having a power source, a conductor and means responsive to current flow on said conductor to detect vehicle presence, adjacent track circuits having power sources of opposite polarity, said transmitters coupled to said conductors via cables and said cables extend beyond said conductors into an adjacent track circuit to enable vehicles to receive information from a one transmitter after crossing into a downstream track circuit over said cables.

15. The apparatus of claim 2 wherein said guideway comprises a plurality of groups of uniquely identified blocks, blocks in one group having a counterpart with identical identification in other groups, at least one said group overlapping in part with another said group comprising an overlapped length said overlapped length beginning at an upstream end of the downstream group and extending to the downstream end of the upstream group.

16. The apparatus of claim 15 in which each of said blocks in said overlapped length having two information storage means and two communication channel sections, each of said information storage means coupled to a different communication channel section, each transmitter means in said overlapped length coupled to one of said communication channel sections, and each transmitter means in blocks upstream of said overlapped length coupled to the other of said communication channel sections.

17. Traffic control system for vehicles travelling in one direction on a guideway, each of said vehicles having a receiver responsive to information communicated thereto and control means responsive to said receiver and to vehicle carried apparatus for controlling the continued operation of said vehicle, said system further including:

a plurality of vehicle detecting means, each associated with a different section of said guideway for detecting the presence, anywhere in said associated section, of a vehicle, a plurality of transmitting means, each associated with a different section of said guideway and responsive to the associated vehicle detecting means for transmitting traffic control information to vehicles in said associated section, and information selecting means coupled to each of said transmitting means for coupling to selected ones of said transmitting means information identifying the next unavailable downstream section regardless of the number of clear sections between a said selected transmitting means and said unavailable section.

18. The apparatus of claim 17 wherein said information selecting means comprises:

a communication channel section associated with each said section having an input and output, coupling means responsive to said vehicle detecting means for coupling the output of said associated communication channel section to the input of a communication channel section of the adjacent upstream block if said vehicle detecting means does not detect presence of a vehicle, and an information storage means associated with each section storing identification of the associated section and coupled to said coupling means, said coupling means coupling said information storage means to the input of the communication channel section of the adjacent upstream section when said vehicle detecting means detects the presence of a vehicle in said section.

19. The apparatus of claim 18 further comprising further storage means associated with each section and coupled to the associated transmitting means for providing information identifying the associated section.

20. The apparatus of claim 19 which includes means coupling timing signals to said information storage means and said further storage means for controlling the times their respective information is transmitted, said timing signals including at least a first and second gating signals of like repitition rate but time displaced from one another.

21. The apparatus of claim 20 which includes: receiving means associated with each said section responsive to a vehicle carried transmitter, said receiving means having an output coupled to said associated communication channel section.

22. The apparatus of claim 20 in which:

said vehicle detecting means includes an upstream vehicle detector and a downstream vehicle detector, each respectively detecting presence of a vehicle in an upstream or downstream segment of said section, and said transmitting means includes an upstream and downstream transmitter transmitting to a vehicle in said upstream or said downstream segment of said section.

23. The apparatus of claim 22 wherein said communication channel section has an upstream and downstream segment, said coupling means has an upstream and downstream coupler, said downstream coupler coupling an output of said communication channel downstream segment to an input of said communication channel upstream segment and said upstream coupler coupling an output of said communication channel upstream segment to an input of a communication channel downstream segment of the next adjacent upstream section.

24. The apparatus of claim 23 wherein said upstream transmitter has an input from said communication channel segment downstream of said downstream coupler and said downstream transmitter has an input from the communication channel segment of the adjacent downstream section coupled downstream of said upstream coupler.

25. The apparatus of claim 22 wherein each said vehicle detector includes:

a track circuit having a power source, a conductor and means responsive to current flow on said conductor to detect vehicle presence, adjacent track circuits having power sources of opposite polarity, said transmitters coupled to said conductors via cables and said cables extend beyond said conductors into an adjacent track circuit to enable vehicles to receive information from a one transmitter after crossing into a downstream track circuit over said cables.

26. The apparatus of claim 18 wherein said guideway comprises a plurality of groups of uniquely identified sections, sections in one group having a counterpart with identical identification in other groups, at least one said group overlapping in part with another said group comprising an overlapped length said overlapped length beginning at an upstream end of the downstream group and extending to the downstream end of the upstream group.

27. The apparatus of claim 26 in which each of said sections in said overlapped length having two information storage means and two communication channel sections, each of said information storage means coupled to a different communication channel section, each transmitter means in said overlapped length coupled to one of said communication channel sections, and each transmitter means in sections upstream of said overlapped length coupled to the other of said communication channel sections.

28. Apparatus for the transmission of traffic control information to vehicles travelling downstream on a guideway comprising a plurality of blocks including at least one merge area where two legs of said guideway merge into a single leg of a guideway, said apparatus comprising:

vehicle detecting means associated with each block for detecting the presence of a vehicle in said block, transmitting means associated with each block for providing traffic control information to a vehicle in said block, receiving means associated with each block for receiving information from a vehicle in said block, communication channel means coupled to said receiving means for transmitting received information downstream to said merge area said communication channel means responsive to said vehicle detecting means of plural blocks to separate information from plural vehicles, and merge block information handling means at said merge area, responsive to said communication channel means and coupled to transmitting means of blocks at least in the vicinity of, and upstream of, said merge block for providing information from vehicles on both legs of said guideway, whereby a vehicle upstream and in the vicinity of said merge area receives information from at least all vehicles downstream of said vehicle and upstream of said merge area on both legs of said guideway.

29. The apparatus of claim 28 wherein said receiving means receives data related to vehicle position, and said merge block information handling apparatus generates a listing of vehicles in accordance with their distance from said merge area.

30. The apparatus of claim 29 wherein said communication channel means comprises a plurality of communication paths associated with each said leg, information from each vehicle separated onto different paths at said merge area by said vehicle detecting means.

31. The apparatus of claim 28 wherein each said block further includes message generating means identifying the associated block and effective when the associated block is occupied, said message generating means providing, at least in part, the information carried on said communication channel means.

* * * * *